United States Patent [19]

Newson

[11] 4,141,314

[45] Feb. 27, 1979

[54] PHOTOCOPYING SYSTEMS

[75] Inventor: David C. Newson, Harefield, England

[73] Assignee: GAF Corporation, New York, N.Y.

[21] Appl. No.: 845,272

[22] Filed: Oct. 25, 1977

[51] Int. Cl.[2] ..... B05C 1/08

[52] U.S. Cl. ..... 118/246; 118/248; 118/261; 354/318

[58] Field of Search ..... 354/318; 118/248, 251, 118/661, 261, 246; 101/407 R

[56] References Cited

U.S. PATENT DOCUMENTS

| | | | |
|---|---|---|---|
| 3,517,646 | 6/1970 | Thomas | 118/411 |
| 3,587,458 | 6/1971 | Feier et al. | 101/407 R X |
| 3,687,049 | 8/1972 | Koch et al. | 118/261 X |
| 3,940,782 | 2/1976 | Neeb et al. | 354/318 |

*Primary Examiner*—John P. McIntosh

[57] ABSTRACT

A developing apparatus for use in a photocopying system includes a rotatably mounted application roller, means for dispensing developer material onto the surface of the roller, a metering blade mounted for engagement with the surface of the roller for wiping the surface of the application roller to leave it lightly wetted with developer, and a pressure application means to apply pressure to a copy paper as it passes in contact with the surface of the roller. The pressure application means is preferably in the form of a curved pad which applies pressure over a substantial area of the application roller and remains in contact with the application roller even when the roller is stationary.

7 Claims, 1 Drawing Figure

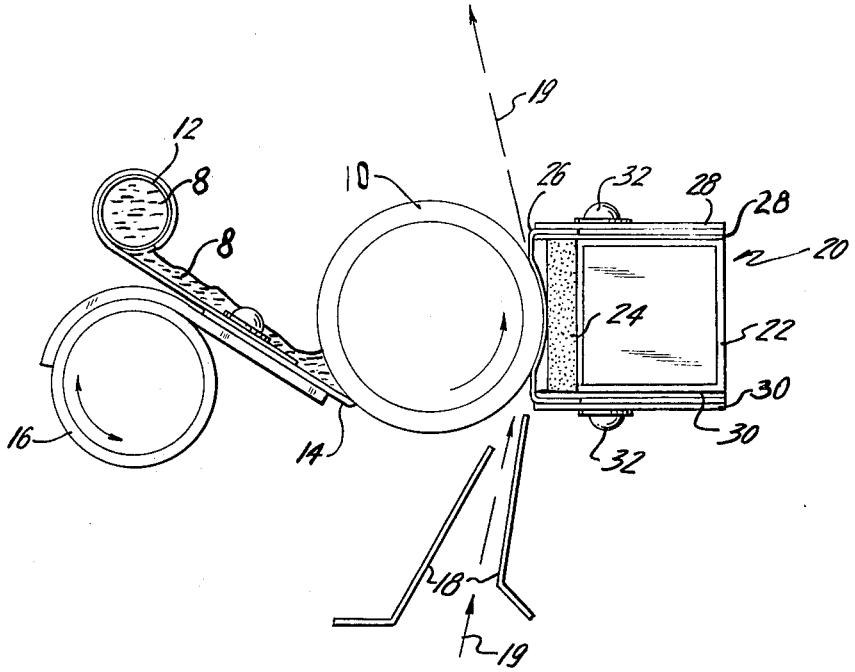
12
8
8
10
19
26
32
28
28
20
24
22
30
30
32
16
14
18
19

PHOTOCOPYING SYSTEMS

BACKGROUND OF THE INVENTION

The present invention relates to photocopying systems and, more particularly, to developing apparatus for developing light sensitive paper and polyester film. The development process requires the sensitive side of the copy material to be coated with a very small amount of developer liquid, this liquid to be distributed evenly over the surface of the copy material, the quantities being in the order of 1.75 to 2.25 grams of liquid per square meter of paper. The major advantage of applying the liquid in such small quantities is that the copies emerge direct from the developing apparatus dry to the touch.

One existing system known as the "pressure diazo" system is disclosed in British Pat. Nos. 1,215,705, 1,349,597, 1,349,598, 1,349,599 and U.S. Pat. Nos. 3,626,833 and 3,640,203. Basically the "pressure diazo" system consists of a rotating roller with a rubber surface having a fine surface texture. The rubber surface effectively transports developer liquid from the developer supply to the surface of the copy material as they meet in rolling contact with each other. The quantity of developer transported is limited by a metering blade which effectively only allows the small amounts of liquid held within the "valleys" of the surface texture to reach the copy material. The transfer of developer liquid from the rubber surface to the copy material is assisted by a pressure applicator device which serves to press the copy material firmly against the rotating rubber surface.

Both the metering device and the pressure applicator device are blade members and are mounted in such a way that, under the influence of a control mechanism, they can be moved into and out of engagement with the roller surface. When engaged the metering blade traps a reservoir of developer liquid downstream of the pressure applicator blade. When a print is presented to the unit, the copy material and the developer laden roller surface meet and are pressed together under the influence of the pressure applicator blade, this causes the major part of the liquid in the "valleys" to transfer onto the activated side of the copy material thus causing it to develop.

When the machine is in operation and the roller is rotating, but the unit is not processing copy material, the pressure of both blades acts directly onto the roller surface. The points of contact are lubricated to some extent by the developer liquid, but this degree of lubrication is not adequate when the roller is rotating at the minimum speed. In order to reduce contact friction and overcome this problem, the blades have been coated with a fluoro carbon plastic such as tetrafluoroethylene polymer.

The movement of the blades, into and out of engagement with the roller surface, occurs when the machine is switched on or off respectively, which ensures that the blades do not bear down under pressure onto the surface of the roller when it is stationary. The effect of this if it should occur, for more than a few hours, would be to mark the surface of the roller with a smooth line measuring the same length as that of the blade. On a microscope scale, the "crests" of the surface texture become depressed into the space of the "valleys" of the same surface texture, thus reducing the liquid carrying capacity of the surface at the pressure set point. When the machine is then used normally, a line of poor development on the copy material will appear corresponding to the line on the roller.

It is therefore the principal object of the present invention to provide a developing apparatus in a photocopying system which overcomes the disadvantages of the prior art by including means to apply pressure on the copy paper against the surface of the application roller without causing marks on the surface of the roller and without requiring means to move the pressure application means away from the roller when the roller is stationary.

Other objects, features and advantages of the invention will become apparent from the description of the invention in connection with the accompanying drawing to be described more fully hereinafter.

SUMMARY OF THE INVENTION

The foregoing objective is accomplished by providing a developing apparatus for use in photocopying system which includes: a rotatably mounted application roller; means for dispensing developer material onto the surface of said roller; a metering blade mounted for engagement with the surface of said application roller for wiping the surface of the application roller to leave it lightly wetted with developer, and pressure application means mounted for applying pressure to copy paper as said copy paper passes in contact with the surface of said application roller for receiving developer material therefrom so that said copy paper is squeezed between the pressure application means and the application roller, said pressure application means remaining in contact with the application roller when the roller is stationary.

Preferably, the pressure application means is in the form of a curved pad which applies pressure over a substantial area of the application roller.

BRIEF DESCRIPTION OF THE DRAWING

The present invention will now be described in greater detail by way of example with reference to the accompanying drawing, wherein the sole FIGURE is a diagrammatic view of one preferred form of developing apparatus for use in a photocopying system.

DESCRIPTION OF THE INVENTION

Referring to the drawing, the developing apparatus includes an application roller 10, which is mounted for rotation on appropriate support means within a photocopying device. A developer dispensing tube 12 is mounted in the photocopying device in close proximity to the application roller 10 for feeding developer material 8 to the roller. A metering blade 14 is arranged for contact with the surface of the application roller for wiping the surface of the application roller to leave it lightly wetted with developer, and a movable blade support 16 for moving the metering blade 14 into and out of contact with the application roller 10 is provided in the device. The apparatus further includes a pair of guides 18 for guiding copy paper into contact with the surface of the application roller, and pressure application means, to be described in greater detail hereinafter, which is designated by the reference numeral 20.

The FIGURE shows the developing apparatus in its operating position with metering blade 14 in contact with roller 10 and with roller 10 rotating.

The path that the copy paper takes is indicated by the arrowed broken lines 19, the activated side thereof being directed towards the application roller 10.

The application roller 10 is rubber covered and is driven by conventional means (not shown). The metering blade 14 is moved into contact with the surface of the application roller 10 by means of the support mechanism 16 as soon as the speed of rotation of the application roller exceeds a given minimum value. This minimum value is selected so that the blade 14 does not damage the roller when it is either started or stopped. It should be pointed out that this is standard practice employed in the known systems in particular the "pressure diazo" system disclosed in the above referred to Patents.

The pressure application means 20 includes a rigid square section tube 22, a pad of soft resilient material 24 carried in the tube 22, a strip of material 26 covering the exposed surface of the pad, two pairs of flat plates 28 and 30 between which ends of the strip 26 can be held, and screws 32 for clamping the ends of the strip 26 between the pairs of plates 28 and 30. The strip of material 26 which is preferably made of a polytetrafluoroethylene polymer has its respective ends held between the pairs of plates 28 and 30 and clamped tightly in position by screws 32.

The pressure application means 20 is applied against the application roller 10 by means (not shown) which are well known in the art, such as spring loaded support arms or brackets. As shown in the drawing, the strip 26 conforms to the shape of the surface of the application roller 10, and the pad 24 gives or is otherwise resilient in its central zone to accommodate the inwards bulge of the strip 26. It should be noted that the ends of the pairs of flat plates 28 and 30 extend slightly beyond the outer surface of the pad 24 to properly hold the ends of strip 26. The pad 24 is preferably made of spongy material such as foam rubber to urge the strip 26 into contact with the roller surface.

The above described pressure application means 20 is advantageous because it contacts the surface of the application roller 10 over a much larger area than the prior blade does, therefore the intensity of pressure (i.e. force per unit area) is correspondingly less. This is therefore much less damaging to the roller surface when the roller is stationary because the "crests" of the surface texture deform to a less degree under the lower pressure. Furthermore any deformation that may occur is distributed over a larger area and, consequently has a far less pronounced effect on the application of developer to the copy material.

The result therefore of replacing the pressure blade of the known systems with the above described pressure application means is that it can be fixed in position and there is no need for the device to be disengaged from the roller surface when the roller is stationary. Thus only the metering blade has been moved away from the roller surface, which means less mechanism with resulting lower maintenance costs.

While the invention has been described and illustrated with respect to a certain preferred embodiment which gives satisfactory results, it will be understood by those skilled in the art, after understanding the purpose of the invention, that various other changes and modifications may be made without departing from the spirit and scope of the invention, and it is therefore intended to cover all such changes and modifications in the appended claims.

What is claimed is:

1. An improved developing apparatus for use in a photocopying system comprising a rotatably mounted application roller, means for dispensing developer material onto the surface of said application roller, a metering blade mounted for engagement with the surface of said application roller for wiping the surface of said application roller, and pressure application means matching the contour of the application roller mounted for applying pressure to copy paper as said copy paper passes in direct contour contact with the surface of said application roller for receiving developer material therefrom so that said copy paper is squeezed between said pressure application means and said application roller, said pressure application means remaining in direct contour contact with said application roller when said roller is stationary.

2. The improved developing apparatus according to claim 1 wherein said pressure application means comprises a support mounted in close proximity to said application roller, a contact strip carried by said support, and means for urging said contact strip into pressure engagement with the surface of said application roller.

3. The improved developing apparatus according to claim 2 wherein said contact strip comprises a strip of polytetrafluoroethylene polymer material, and wherein said means for urging said contact strip into pressure engagement with said application roller comprises a pad of resilient material.

4. The improved developing apparatus according to claim 3 wherein said support comprises a rigid square section tube.

5. The improved developing apparatus according to claim 4 further comprising means for clamping said contact strip in place on said rigid square section tube.

6. The improved developing apparatus according to claim 5 wherein said means for clamping said contact strip comprises two pairs of plates carried on said square tube for supporting therebetween respective ends of said contact strip, and a screw associated with each pair of said plates for clamping said material therebetween.

7. The improved developing apparatus according to claim 6 further comprising means for moving said metering blade into and out of engagement with the surface of said application roller.

* * * * *